United States Patent [19]

Christian, III

[11] 4,271,545

[45] Jun. 9, 1981

[54] ADAPTER FOR ADJUSTABLE HOSPITAL BEDS

[76] Inventor: Fredrick W. Christian, III, 11242 Pearl St., Los Angeles, Calif. 90064

[21] Appl. No.: 61,891

[22] Filed: Jul. 30, 1979

[51] Int. Cl.[3] ..... A47C 21/00

[52] U.S. Cl. ..... 5/66; 5/68; 64/4; 248/674

[58] Field of Search ..... 5/66–68, 5/108, 109; 64/4; 248/674

[56] References Cited

U.S. PATENT DOCUMENTS

| | | | |
|---|---|---|---|
| 1,371,325 | 3/1921 | Schank | 248/674 |
| 2,998,215 | 8/1961 | Brown | 248/674 |
| 3,230,554 | 1/1966 | Peterson | 5/66 |
| 3,797,273 | 3/1974 | Benoit et al. | 5/66 |

*Primary Examiner*—Casmir A. Nunberg

*Attorney, Agent, or Firm*—William H. Maxwell

[57] ABSTRACT

An adapter universally applicable to manually operable hospital beds from which the handles or cranks are removed in order to expose the drive pins of the operating shafts, and comprised of a housing adapted to right and left installation to the shaft cover tubes above or below the bed frame, and having a worm and gear driven hub for coupled engagement with said drive pins and with cam actuated limit switches adjustable for rotative angular displacement as circumstances require.

14 Claims, 9 Drawing Figures

"FOOT"

"HEAD"

ADAPTER FOR ADJUSTABLE HOSPITAL BEDS

BACKGROUND

Hospital beds are characterized by adjustment of the head and foot with lift means which elevate the head and foot portions of the springs and mattress respectively. Basically, this type of bedding is mechanical with hand operated cranks, with the availability of similar systems that operate electrically and hydraulically. However, the greatest need arises in the basic manually operated bed to be converted and automated so that the invalid can conveniently power operate the same, and to this end it is a general object of this invention to provide a motor powered adapter unit for operating the lift screws of such beds.

The normal hospital bed comprises a frame with articulated head and foot sections that are raised from a horizontal plane by means of manually operable lift means. In practice, there is one lift means along one bed rail to raise and lower the head portion, and one lift means along the other bed rail to raise and lower the foot portion. In the manual version, the lift means for the head and foot are substantially alike and comprised of hand cranked screw jacks operating levers that raise and lower the mattress supporting frame sections. A characteristic feature of these hospital beds is the cover tube that extends over the engageable end portions of the screw shafts, normally engaged by a swivel handle or crank. There are two general types of handle or crank couplings, the handle version which comprises a transverse pin extending between opposite sides of a slotted screw shaft for swivelled driving engagement with the handle, and the crank version which comprises a transverse pin projecting diametrically at opposite sides of the screw shaft for releasable driving engagement with a socketed hub of the crank. Either version is compatable with the present invention, the crank drive pin as is, and the handle drive pin removed and/or replaced with a crank drive pin as described above. Therefore, it is an object to provide modification of the screw shaft of the handle type, replacing the drive pins as necessary for coupled engagement with the sleeve coupler of the present invention.

The drive hubs of worm and gear actuators have been restricted in rotative angular displacement by limit switches and the like applied to the members actuated, and all of which requires limit means associated with the frame members of the hospital bed sections to be positioned. With the present invention it is an object to integrate such limit means, for varied angles of displacement, within the confines of the worm and gear actuator and associated directly with the drive hub, to operate limit switches at one or both ends of travel, as circumstances require. In practice, the worm is self locking with the gear driven thereby, and the drive hub is integral with the said gear and with a thread helix on the hub in constant mesh with a timing gear to which replaceable cams are keyed to actuate limit switches, one for each direction of travel.

The aforesaid worm and gear actuator and switch controlled limit means is enclosed in a single housing comprised of two half shells to which a drive motor is applied and which exposes the drive hub on bearings for coupled engagement with the screw shaft as will be described. A feature of adaptability is the mounting bracket that accommodates bed construction with either upper or lower cover tubes, a "crank over" bed being shown herein, where the cover shaft operates over the frame at either side of the foot of the bed (see FIG. 2). It is to be understood that there are "crank under" beds where the screw shaft operates in a cover tube disposed beneath the frame at either side of the bed foot, and to which the adapter unit of the present invention is equally applicable. It is an object of this invention to clamp the adapter unit to such tubes while embracing the transverse frame member at the foot of the bed, so as to secure the drive unit as such and to ensure the transmission of torque therefrom.

SUMMARY OF INVENTION

This invention relates to motorized drive adapter for adjustable hospital beds wherein jack screw shafts are accessible within cover tubes at opposite sides of the bed, exposed beneath the mattress frame section at the foot of the bed in each instance. This adapter as a unit is applicable to said screw shaft in lieu of the usual handles or cranks used for manual operation, and is characterized by a worm and gear drive hub that couples to diametrically exposed ends of a pin extending through the screw shaft. A feature is the direct coupled limit switches within the actuator housing, controlling rotational angular displacement in both directions, all of which can be modified by readjustment of cam members or by replacement thereof as may be required. The adapter units are readily coupled to the screw shafts and secured into working position by brackets and clamps anchored to the cover tubes or to the end most frame member of the bed. One basic drive adapter unit suffices for the limits of movement involved in both the head and foot sections of the bed frame to be positioned as desired.

The foregoing and other various objects and features of this invention will be apparent and fully understood from the following detailed description of the typical preferred form and application thereof, throughout which description reference is made to the accompanying drawings.

PREFERRED EMBODIMENT

Figure 1:
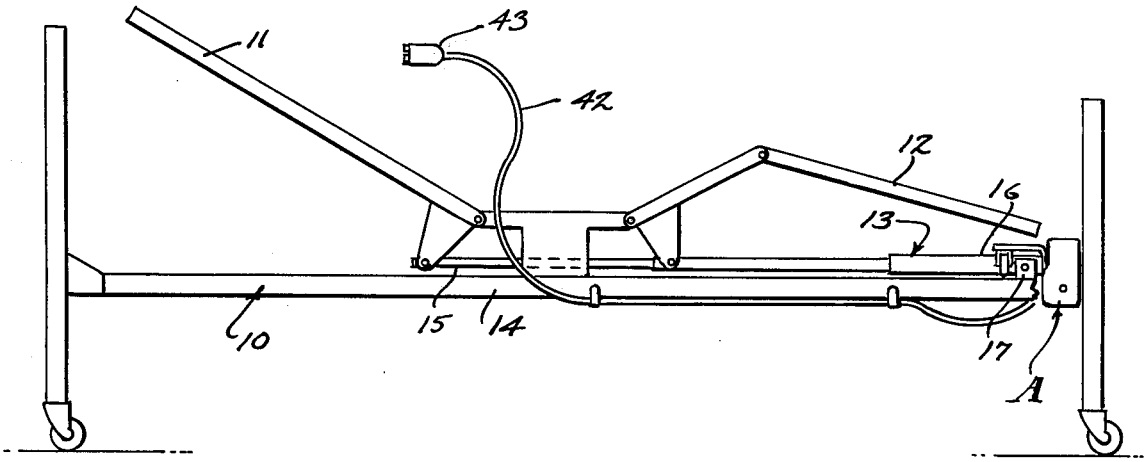
FIG. 1 is a side elevation of a hospital bed showing the installation of the adapter unit of the present invention.
Figure 2:
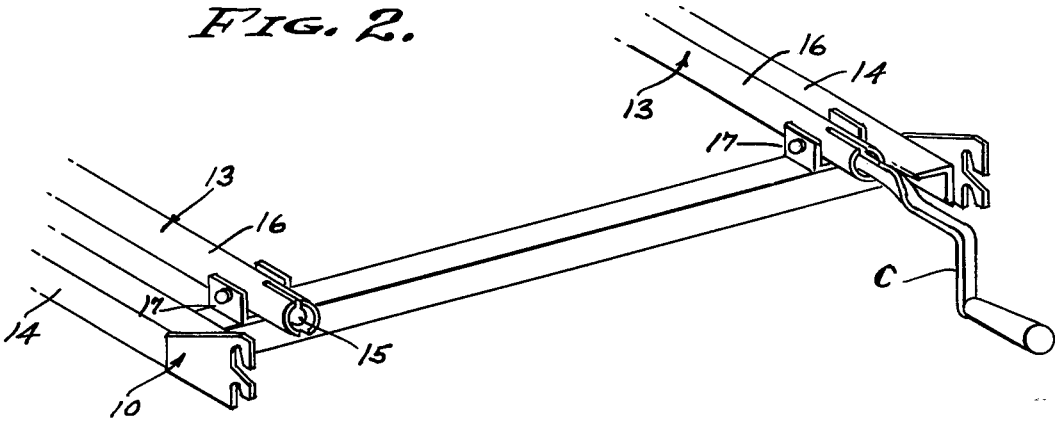
FIG. 2 is a perspective view showing a portion of the hospital bed with one operating handle in position and the other removed so as to expose the cover tube and screw shaft therein.

As shown in FIG. 1 of the drawings, the hospital bed comprises a frame 10 with articulated head and foot sections 11 and 12 that are raised from a horizontal plane by means of manually operable screw jacks 13. In practice, there is one screw jack 13 along each opposite bed rail 14 to raise and lower the head portion and foot portion separately. The screw jacks 13 are substantial and incorporate the required thrust bearings and strength throughout to sustain normal use and abuse. Manual operation of the screw jacks 13 is by means of a handle (not shown) or by a crank c as shown in FIG. 2, one of which is removed to expose the screw shaft 15 that is housed within a protective cover tube 16 carried in a swivel mounting 17. With this invention, the crank C is discarded and the cross pin 18 therefor mated with diametrically opposite keyways in the drive hub sleeve that characterizes the drive adapter unit A, as will be described.

The cover tube 16 projects from the front of the bed frame with the screw shaft 15 protectively enclosed therein. When the hand crank is removed the cross pin 18 is recentered or replaced so as to establish and present diametrically opposite drive lugs projecting from the spindle within the cover tube annulus as shown, and it is within this annulus where driving connection is made when said screw shaft 15 is coupled with the instant adapter unit A. Accordingly, the adapter unit A, for right and left hand installation, involves a housing H that carries an electrical motor M to turn a drive tube T through a worm and gear speed reducer means R operating limit switch means S through a timing gear G and cam means C restricting the screw rotation. The motor M is reversible and controlled by the patient through push button circuits in series through forward and reverse limit switches 19 and 20. The single stage speed reducer means R comprises a worm 21 and a gear 22, a single pitch worm of relatively small diameter, and in practice a forty tooth gear of relatively large diameter. It is to be understood that a multi-pitch worm can be employed to increase the speed of gear 22. Mounting of the housing H enclosing the gearing and timing means is by a bracket B and clamp means K, and all of which is described in detail as follows:

The adapter unit A involves the housing H within which the end portion of the cover tube 16 is received for coupled engagement with the drive tube T. Accordingly, the housing H is positioned over the tube 16 by the bracket B and anchored by the clamp means K. In the case of the "crank over" installation shown, the bracket B overlies the cover tube 16 to embrace or bridge over the swivel mounting 17, with the housing H carried thereby outside the frame and mounting 17, and with the clamp means K inside the frame and mounting 17. As shown, the bracket B is an "L" shaped member wherein the short leg 23 carries the housing H and the long leg 24 overlies the swivel 17 to be anchored to the cover tube 16 by the clamp means C. In practice, the clamp means K is comprised of a "U" bolt 25 and saddle 26 secured to leg 24 by nuts screw threaded onto the bolt; thereby securely positioning the inner end of the bracket. The leg 23 of said bracket is characterized by an aperture or opening 27 through which the cover tube 16 passes with clearance to enter into the drive tube T within the housing H. A symmetrical hole pattern is provided for connection of the bracket B and housing H, whereby the rotative positioning thereof can be altered for different installations as may be required.

The housing H operates on the axis a of the rotatable screw shaft 15 which is substantially coextensive with the cover tube 16. The housing H is comprised of like mating halves, right and left, seperably joined at a vertical plane coincidental with the said axis a, and with a front wall 28 open in a plane normal to said axis a in order to receive the end portion of the cover tube 16 and drivable end of the screw shaft 15 with the diametrically exposed cross pin 18. The housing provides bearing means, and in practice the front and back walls 28 and 29 of the housing H are open with bearings 30 and 31 to rotatably journal the drive tube T, the interior of the housing being enlarged concentrically with the rotational axis a to accommodate the speed reducer R, and opened laterally to accommodate the timing gear G and limit switch means S. The motor and drive shaft 36 is offset from and right angularly related to the axis a, and is journaled on an axis b by the bearings (not shown) of motor M mounted to a side wall 34 of the housing by screw fasteners as shown. The axis b is at one side of the housing interior, preferably adjacent to the front wall 28 and to bearing 30 at the driven end of the drive tube T. The timing gear shaft 37 is also offset and right angularly related to the axis a, and is journaled on an axis c in bearings 38 and 39 in the side walls 34 and 35 of the housing and in parallel relation to the shaft 36. The axis c is at the other side of the housing interior adjacent the back wall 29. The mating halves of the housing H are secured together by spaced screw fasteners as shown.

The motor M can vary as required according to available power etc., and is reversible, being wired through a cable 40 to a junction box 41. A flexible control cable 42 extends from said box to the patient upon the hospital bed, there being a reverse control and operating switch means 43 at the terminal end of the cable for manual control from the patient.

The drive tube T is free to turn in the bearings 30 and 31. Accordingly, the opposite bearing ends 43 and 44 thereof are of right cylinder form, there being outwardly disposed axial thrust faces adjacent thereto respectively. The drive gear 22 is carried by the tube T adjacent the bearing 30, having teeth pitched to be driveably engaged with the worm 21. Intermediate the gear 22 and opposite end bearing 31 there is a helical thread 45, preferably a single pitch thread for driving the timing gear G. The drive tube provides coupling means, and in practice there is a wall 33 closing the back end of the drive tube T and from which a coupling sleeve 46 projects concentrically therewith. A feature of the invention is that the sleeve fits freely into the annulus between the screw shaft 15 and cover tube 16, there being diametrically opposite and open ended slots 47 longitudinally of the sleeve to engage with the cross pin 18 projecting radially from the end portion of the said screw shaft. This telescoped engagement holds the adapter unit A concentric with the screw shaft 15 and driven thereby.

The reducer R comprised of the worm 21 and gear 22 operates at a substantial speed reduction, and includes a single pitch worm 21 that meshes with the gear 22 of 40 teeth to provide a reversible self locking 40 to 1 reduction.

Figures 4, 8, 9:
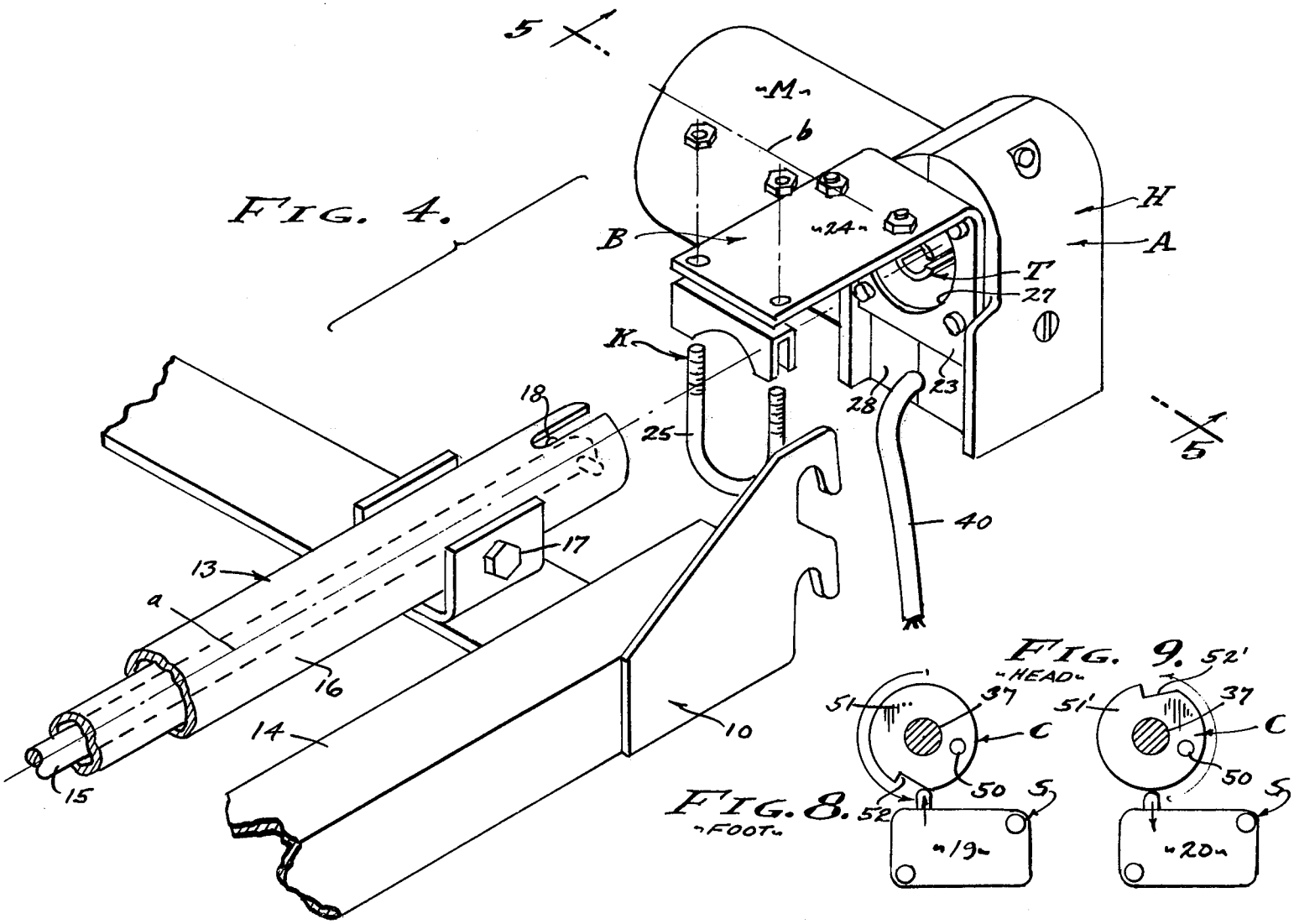
FIG. 4 is an exploded perspective view showing the relationship of the adapter unit to the cover tube.
Figure 5:
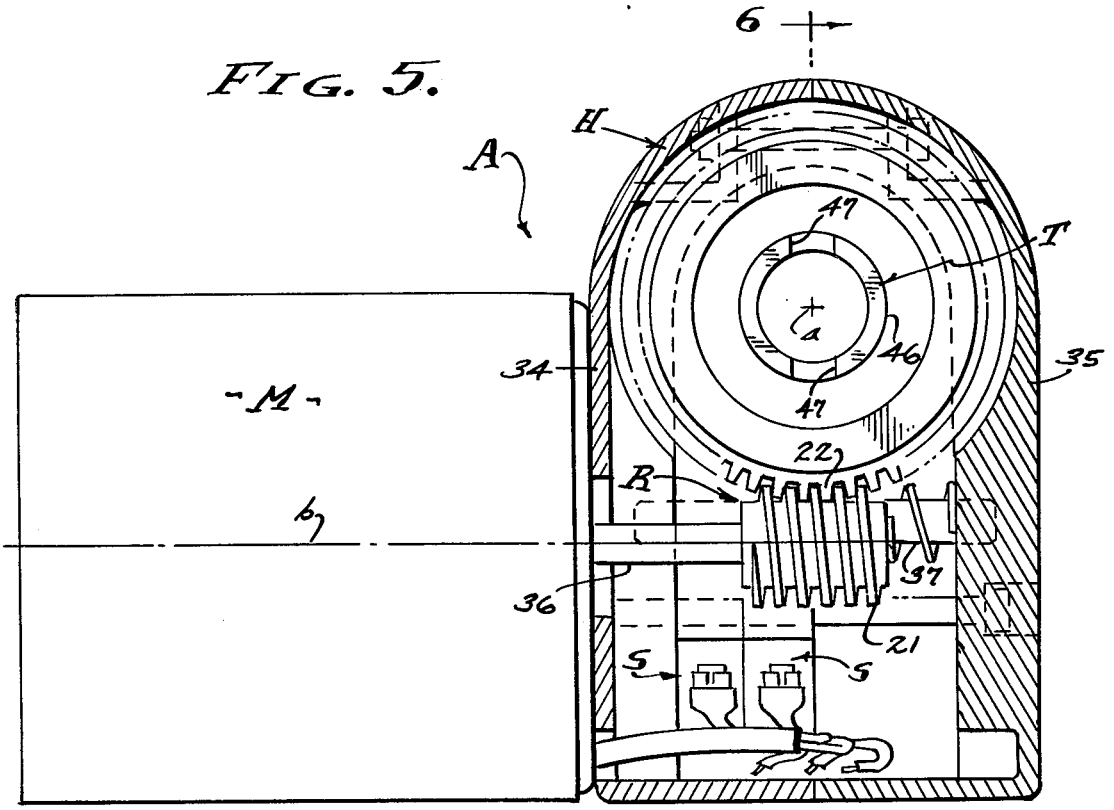
FIG. 5 is an enlarged detailed sectional view taken as indicated by line 5—5 on FIG. 4.
Figure 6:
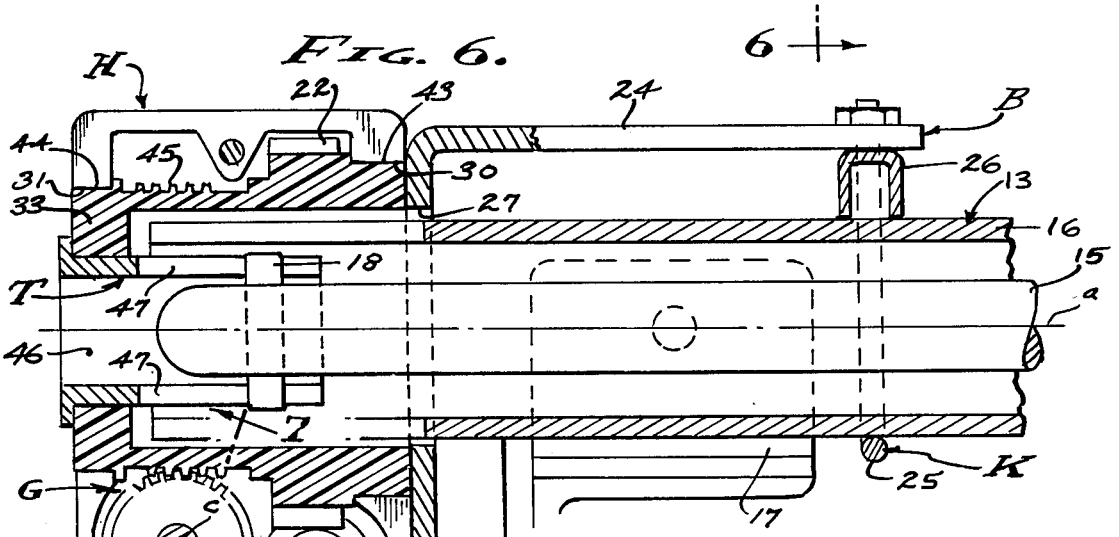
FIG. 6 is a detailed sectional view taken as indicated by line 6—6 on FIG. 3.
Figure 7:
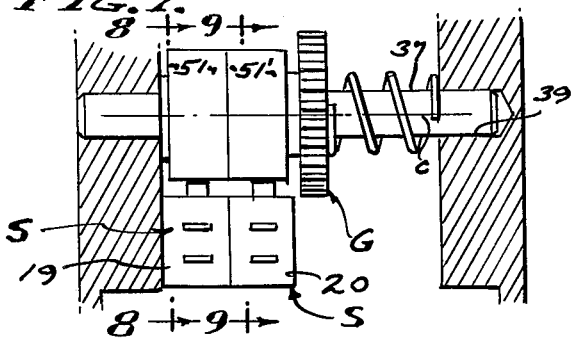
FIG. 7 is a fragmentary view taken as indicated by line 7—7 on FIG. 6. And, FIGS. 8 and 9 are detailed views of the reversely installed cams taken as indicated by line 8—8 and 9—9 on FIG. 7 and which characterize the rotational limit means as will be described.

The timing gear G is carried by the shaft 37 in centered engagement meshed with the peripheral threads 45 on the drive tube T. The timing gear turns on or with the shaft 37 and has affixed thereto the cam means C. In accordance with the invention, there is a drive pin 50 to driveably receive a pair of like cams 51 and 51' engaged over shaft 37, one cam to determine the limit of turns in one direction and the other cam to determine the limit of turns in the other direction. In carrying out the invention the cams are identical and one reversely installed with respect to the other. For example, the two control cams as shown in FIGS. 8 and 9 are reversely engaged by a common drive pin 50 with one cam incline or depression 52 to limit counterclockwise rotation and with the other cam incline or depression 52' to limit clockwise rotation. As shown, the two switches 19 and 20 are in the forward and reverse circuits to motor 17 and are carried in the housing H with followers to be actuated by the two cams respectively. For example, bed head controlling cam of FIG. 8 permits 29 revolutions of worm 21, while the bed foot controlling cam of FIG. 9 permits 13 revolutions of the worm 21. It will be observed that the cam 2 in either application are formed identically with respect to the drive opening therein, and that the depressions 52 and 52' are symmetrically positioned when they are reversely installed on the shaft 37 and engaged over said drive pin 50.

Figure 3:
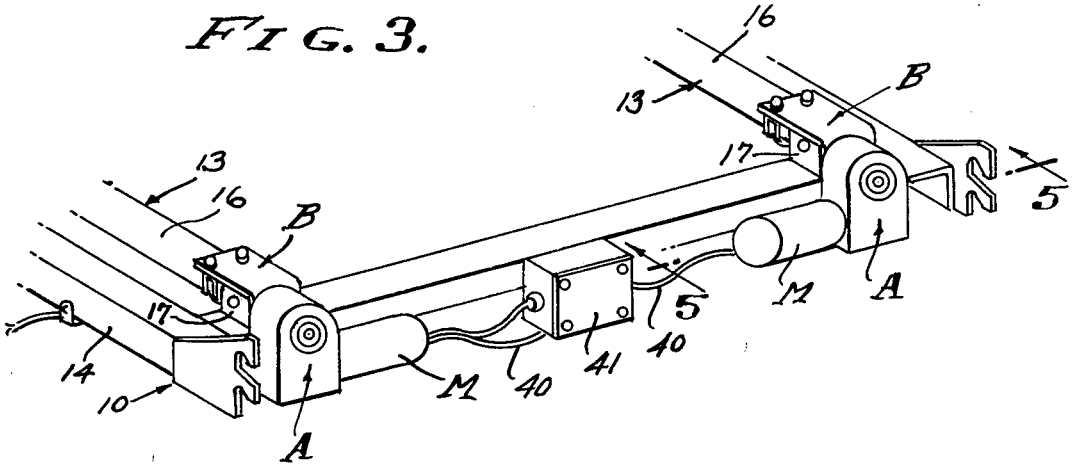
FIG. 3 is a view similar to FIG. 2 showing the installation of adapter units at opposite sides of the hospital bed to operate both the head and foot adjustments thereof.

From the foregoing it will be seen that the manually operable handles and/or cranks are removed from the hospital bed as clearly shown in FIG. 1, and that the adapter units A are installed over the head and foot operating cover tubes at opposite sides of the bed as clearly shown in FIG. 3. The cams of FIGS. 8 and 9 are selectively installed in the adapter units A for "head" and "foot" adjustments of the hospital bed, through the corresponding screw shaft 15 to which they are coupled. The electrical power and control wiring extends through the cables 40 and into the junction box 41 from which the flexible cable 42 extends to the patient. The brackets B are anchored by the clamp means K, all of which is closely confined to the bed frame and easily accessible for installation and service.

Having described only a typical preferred form and application of my invention, I do not wish to be limited or restricted to the specific details herein set forth, but wish to reserve to myself any modifications or variations that may appear to those skilled in the art as set forth within the limits of the following claims:

I claim:

1. A motorized adapter unit for adjustable hospital beds having an operating shaft extending concentrically within and coextensively to the open end of a cover tube with a swivel mounting to a member of the bed frame, and including;

a bracket extending over the open end of the cover tube and embracing the swivel mounting to said member of the bed frame, with clamp means anchoring the bracket to the cover tube at the side of the mounting remote from the open end of the cover tube, a housing carried by the bracket and open to receive the end portion of the cover tube through bearing means concentric with said cover tube, a drive tube journaled in said bearing means in telescopic engagement over the end portion of the cover tube, and having an end wall carrying a sleeve concentric therewith and entering into the cover tube and with coupling means driveably engaging the operating shaft, a motor and gear drive carried by and revolving the drive tube within the housing, a timing gear and cam means driven by the drive tube within the housing, and limit switches actuated by the timing gear and cam means to limit the number of counterclockwise and clockwise revolutions of said drive tube.

2. The motorized adapter unit as set forth in claim 1, wherein the bracket is an "L" shaped member with a leg having an opening engageable over the end portion of the cover tube to carry the housing, and with a leg along the cover tube to extend over the swivel mounting and embrace the same.

3. The motorized adapter unit as set forth in claim 1, wherein the clamp means is a "U" bolt secured by fasteners to anchor the bracket.

4. The motorized adapter unit as set forth in claim 1, wherein the bracket is an "L" shaped member with a leg having an opening engageable over the end portion of the cover tube to carry the housing, and with a leg along the cover tube to extend over the mounting and embrace the same, and wherein the clamp means is a "U" bolt secured by fasteners to anchor the bracket.

5. The motorized adapter unit as set forth in claim 1, wherein the housing comprises mating halves forming the said bearing means open to receive and journal the drive tube telescopically engaged over the end portion of the cover tube.

6. The motorized adapter unit as set forth in claim 1, wherein the housing comprises mating halves forming an interior with spaced bearings to accommodate and openly receive and journal the drive tube telescopically engaged over the end portion of the cover tube.

7. The motorized adapter unit as set forth in claim 1, wherein the operating shaft carries a cross pin with at least one diametrically exposed end, and wherein the sleeve carried by the drive tube has at least one open ended drive slot to receive and driveably engage the cross pin.

8. The motorized adapter unit as set forth in claim 1, wherein the operating shaft carries a cross pin with diametrically exposed ends, and wherein the sleeve carried by the drive tube has diametrically opposite and open ended drive slots to receive and driveably engage the exposed cross pin ends.

9. The motorized adapter unit as set forth in claim 1, wherein the motor and gear drive comprises a drive shaft extending into the housing from the motor at the exterior thereof and on an axis spaced from and normal to the drive tube carrying a gear meshed with a worm on said drive shaft.

10. The motorized adapter unit as set forth in claim 1, wherein the drive tube has a peripheral thread, and wherein the timing gear and cam means is meshed with said thread to revolve with respect to the number of counterclockwise and clockwise revolutions of said drive tube.

11. The motorized adapter unit as set forth in claim 1, wherein the drive tube has a peripheral thread, and wherein the timing gear and cam means comprises a timing gear in constant mesh with said thread to revolve with respect to the number of counterclockwise and clockwise revolutions of said drive tube, and a pair of reversely installed cams driven by the timing gear to actuate the said limit switches for counterclockwise and clockwise limits of revolvement of the drive tube respectively.

12. The motorized adapter unit as set forth in claim 1, wherein the drive tube has a peripheral thread, and wherein the timing gear and cam means comprises a timing gear in constant mesh with said thread to revolve with respect to the number of counterclockwise and clockwise revolutions of said drive tube, and a pair of identical reversely installed cams driven by a common drive pin projecting from the timing gear to actuate the said limit switches for counterclockwise and clockwise limits of revolvement of the drive tube respectively.

13. The motorized adapter unit as set forth in claim 1, wherein the drive tube has a peripheral thread, and wherein the timing gear and cam means comprises a timing gear in constant mesh with said thread to revolve with respect to the number of counterclockwise and clockwise revolutions of said drive tube, and a pair of cams with peripheral inclines identically positioned with respect to a drive opening driven by a common drive pin projecting from the timing gear to actuate the said limit switches for counterclockwise and clockwise limits of revolvement of the drive tube respectively.

14. The motorized adapter unit as set forth in claim 1, wherein the bracket is an "L" shaped member with a leg having an opening engageable over the end portion of the cover tube to carry the housing, and with a leg along the cover tube to extend over the swivel mounting and embrace the same, wherein the clamp means is a "U" bolt secured by fasteners to anchor the bracket, wherein the housing comprises mating halves forming an interior with spaced bearings to accommodate and openly receive and journal the drive tube telescopically engaged over the end portion of the cover tube, wherein the operating shaft carries a cross pin with diametrically exposed ends, wherein the sleeve carried by the drive tube has diametrically opposite and open ended drive slots to receive and driveably engage the exposed cross pin ends, wherein the motor and gear drive comprises a drive shaft extending into the housing from the motor at the exterior thereof and on an axis spaced from and normal to the drive tube carrying a gear meshed with a worm on said drive shaft, wherein the drive tube has a peripheral thread, and wherein the timing gear and cam means comprises a timing gear in constant mesh with said thread to revolve with respect to the number of counterclockwise and clockwise revolutions of said drive tube, and a pair of cams with peripheral inclines identically positioned with respect to a drive opening driven by a common drive pin projecting from the timing gear to actuate the said limit switches for counterclockwise and clockwise limits of revolvement of the drive tube respectively.

* * * * *